United States Patent [19]

di Carlo

[11] 3,950,966

[45] Apr. 20, 1976

[54] DEMAND RESPONSIVE POSITIVE FEED DEVICE FOR KNITTING MACHINE

[75] Inventor: Joseph Scotto di Carlo, Cornwells Heights, Pa.

[73] Assignee: Scorpio Industries Inc., Neponsit, N.Y.

[22] Filed: May 12, 1975

[21] Appl. No.: 576,408

[52] U.S. Cl. ..... 66/132 T; 242/47.01

[51] Int. Cl.[2] ..... D04B 15/48

[58] Field of Search ..... 66/132 T, 140, 159, 66/160, 163, 161, 162; 242/47.01

[56] References Cited

UNITED STATES PATENTS

| | | | |
|---|---|---|---|
| 727,429 | 5/1903 | Patterson | 66/163 |
| 2,383,838 | 8/1945 | Auble | 66/163 |
| 2,549,701 | 4/1951 | Mishcon et al. | 66/140 R |
| 3,264,845 | 8/1966 | Rosen | 66/132 T |
| 3,388,565 | 6/1968 | Mishcon | 66/161 |
| 3,482,420 | 12/1969 | Bourgeois | 66/163 |
| 3,726,113 | 4/1973 | Levin et al. | 66/163 |
| 3,737,112 | 6/1973 | Tellerman et al. | 242/47.01 |
| 3,802,228 | 4/1974 | Deniega | 66/132 T |
| 3,851,502 | 12/1974 | Hopkins | 66/163 |

OTHER PUBLICATIONS

Knapton, Dr. J. F., *Knitting High Quality Double Knit Cloth*, Part I in Knitting Times, Sept. 25, 1972, 41(40): PP. 87–91.

*Primary Examiner*—Mervin Stein
*Assistant Examiner*—Andrew M. Falik
*Attorney, Agent, or Firm*—Elliott I. Pollock

[57] ABSTRACT

A knitting machine is provided with a plurality of positive feed devices for feeding yarn from a plurality of yarn packages to a plurality of feeding stations. The positive feed devices comprise a plurality of rotatable rollers associated with a driven tape running along the surfaces of the rollers and having a width less than the axial dimension of each roller, and a yarn guide comprising a bracket having eyelets to guide the yarn is mounted for free pivotal movement adjacent each roller to position a length of yarn onto the tape for positive feeding or to displace the yarn away from the tape for nonfeed thereof. The position of the yarn guide is controlled by one or more weights which are attached to the bracket at positions displaced from the bracket pivot point to urge the bracket and its eyelets into the nonfeed position under the influence of gravity. When a particular yarn is demanded by a feeding station, the resulting tension in that particular yarn causes the bracket to pivot in the opposite direction against the force of the attached weight to shift the yarn guide into the positive feed position automatically. Subsequent release of tension in the yarn causes the weight to predominate thereby to automatically return the yarn guide to its non-feed position.

8 Claims, 6 Drawing Figures

FIG. 1.
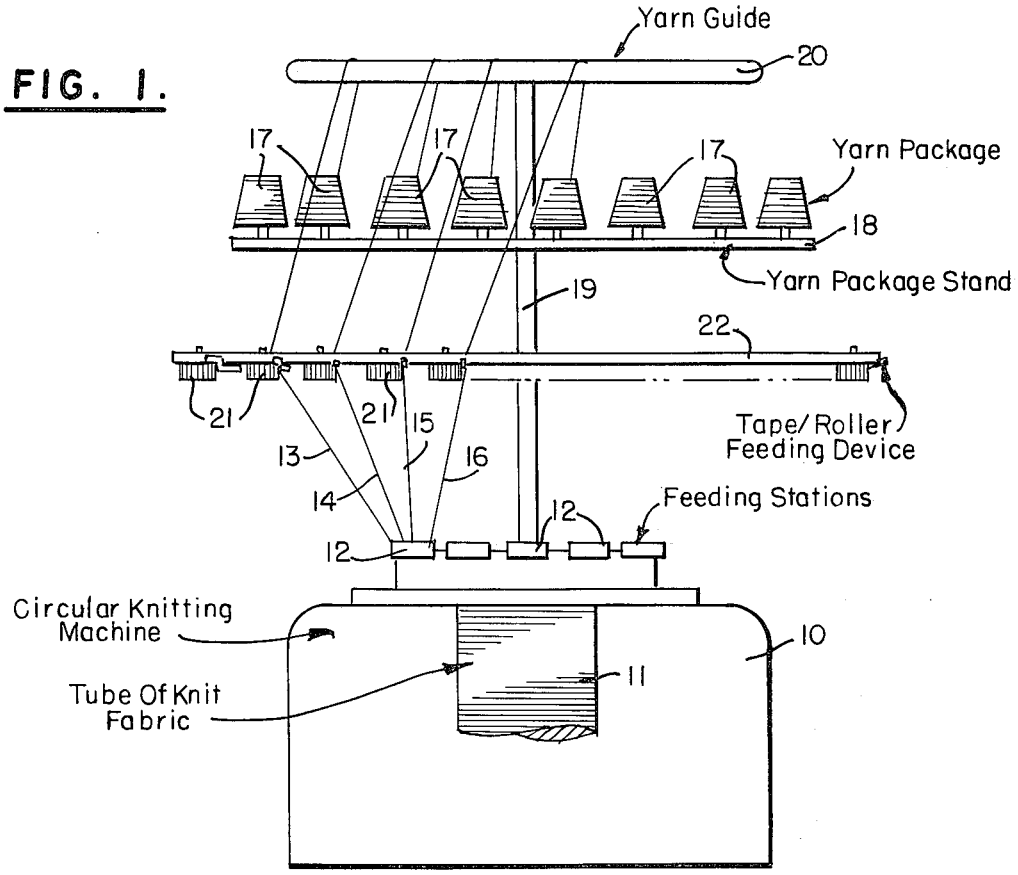
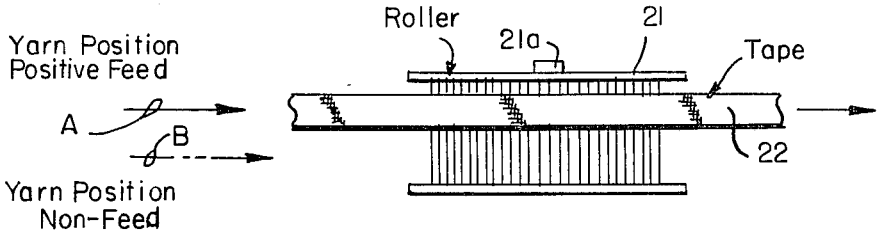
FIG. 2.

FIG. 3A.
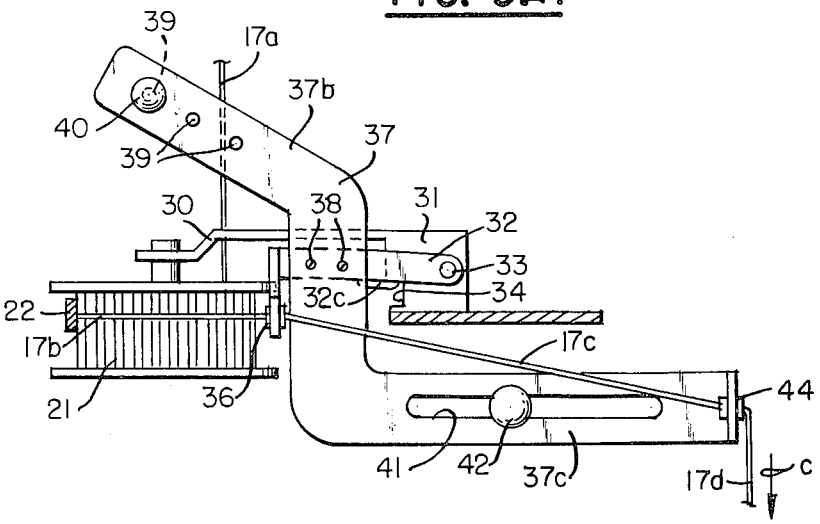
FIG. 3B.
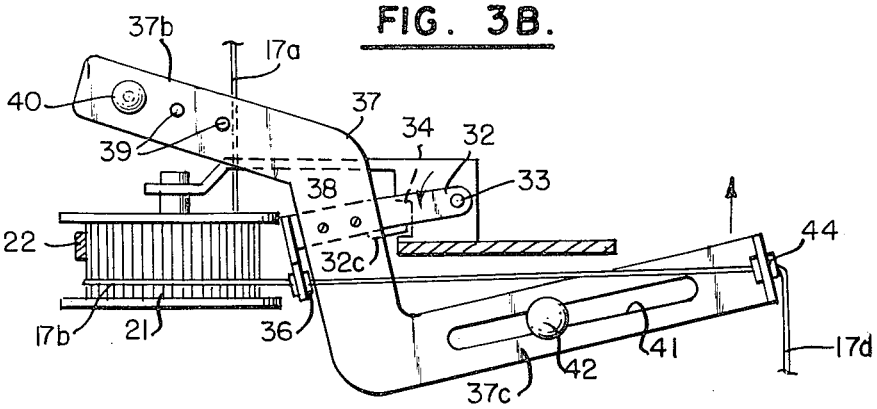
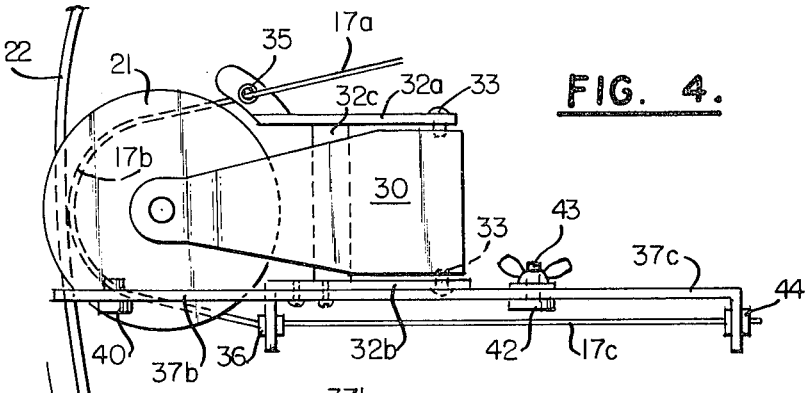
FIG. 4.
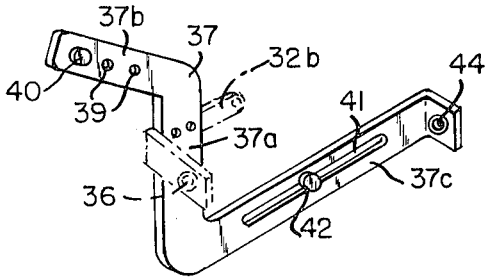
FIG. 5.

DEMAND RESPONSIVE POSITIVE FEED DEVICE FOR KNITTING MACHINE

BACKGROUND OF THE INVENTION

Over the years, a variety of positive feed devices have been developed for use in multifeed knitting machines, to assure that, during the operation of the machine, predetermined increments of yarn will be fed from the yarn packages to the machine needles. One of the most widely used mechanisms of this type is described in Rosen U.S. Pat. No. 3,090,215 wherein the positive feed device comprises a plurality of rollers having an endless tape running over the surface of the rollers and driven by the machine during its normal operation, with the yarns being supplied by appropriate guide means to locations between the tape and roller surfaces so as to be positively fed as the tape is driven. In a variation of this general structure, shown for example in Rosen U.S. Pat. No. 3,264,845, and Deniega U.S. Pat. No. 3,802,228, the tape is made narrower than the running surface of the roller, and the yarn guide is arranged to be selectively displaced between a first position located under the tape to effect positive feeding of the yarn, and a second position which is axially displaced from the tape to stop the yarn feed. These variations in structure are provided for "stop-motion" purposes, i.e., while the yarn is normally located under the tape of the feed device, if the yarn should break an operator can manually displace the yarn guide of each yarn feed device to stop the yarn feeding operations and/or, particularly if a mechanism is provided which detects a yarn break, to completely stop operation of the machine. Other positive feeding arrangements capable of achieving these same general results are described in Rosen U.S. Pat. Nos. 3,419,225 and 3,796,384, Tannert U.S. Pat. No. 3,709,444, and Jacobsson U.S. Pat. No. 3,791,599.

Roller/tape positive feeding devices of the general type described above have been widely adopted for use in a number of different types of knitting machines, but have not been considered practical for use in machines where it is required that different yarns be selectively fed to the machine on a demand basis. In machines of this latter type, one example being the so-called striping machine wherein a plurality of differently colored yarns are fed to a common striping box which functions, as the machine operates, to demand successively different ones of said yarn in a predetermined repetitive sequence, conventional roller/tape positive feeding devices have been considered incapable of accommodating the changing demands of the machine due to the fact that such devices do not have the facility to respond in a bi-directional manner to the demand or lack of demand of a given yarn. In a still further arrangement described in Nance U.S. Pat. No. 3,418,831, an effort has been made to adapt the Rosen-type positive feeding device to machines operating on a demand basis, through the provision of mechanisms taking the form of elongated rods and/or signal responsive solenoids intended to shift the yarn guide of the positive feed device between feed and nonfeed positions in dependence upon the changing demands of the knitting machines. Devices of the Nance type, however, are extremely complex and costly to install and maintain, and therefore have not found any general acceptance in the knitting machine field.

The present invention provides an improved form of roller/tape positive feed device which is adapted to positively feed yarn to a knitting machine on a selective basis responsive to the demands of the machine, and which is capable of achieving such positive demand feeding in an arrangement which is completely automatic in operation and far simpler, less costly, and more reliable than structures suggested heretofore e.g., of the aforementioned Nance type.

SUMMARY OF THE INVENTION

In accordance with the present invention, positive feed devices of the general type suggested heretofore, i.e., comprising a plurality of rotatable rollers associated with a driven tape which is narrower than the running surface of each roller and which is provided with a selectively displaceable yarn guide having inlet and outlet eyelets movable between positive feed and nonfeed positions adjacent each roller, is modified to incorporate a mechanism which responds automatically to the machine demand for a particular yarn to position that yarn at either a positive feed or a nonfeed position adjacent its associated feed roller. In accordance with the modification of the present invention, the inlet and outlet eyelets of each positive feeding device are supported on a bracket which is freely pivotal through a limited arc, and the actual position of the bracket is determined automatically under the joint influence of one or more weights which are attached to the bracket at positions displaced from the bracket pivot point, and the existing tension or lack of tension in the yarn which passes through the feeding device in question.

In a particular form of the invention to be described hereinafter, the counterbalance weights are attached to the aforementioned freely pivotal bracket by a mounting device which includes a pair of elongated arms extending in opposite directions relative to the bracket pivot point, with each arm including provision for supporting a weight thereon. In a preferred form of the invention, the actual position of each weight is adjustable along its associated arm toward and away from the bracket pivot point to permit the positions of the yarn guide to be adjusted in dependence upon the tension existing in a particular yarn when that yarn is being demanded by the machine. The adjustment is such that, when there is no demand for the particular yarn, the influence of the counterbalance weights predominates to pivot the bracket, under the influence of gravity, into a nonfeed position. At least one of the arms further includes a mechanism which engages the particular yarn passing through the positive feed device in question, e.g., an additional eyelet is provided at an extremity of one of the arms so that when that particular yarn is being demanded by the machine, the tension resulting in the demanded yarn overcomes the gravity influence of the aforementioned counter weights and pivots the bracket and its associated eyelets into a positive feed position wherein said particular yarn is located under the tape. When the demand for the particular yarn in question ceases, the resultant release of tension in that yarn causes the influence of the aforementioned counter weights to again predominate so that the bracket returns, under the influence of gravity, to its nonfeed position.

The resulting mechanism preserves all of the advantages of conventional roller/tape positive feed devices, but adapts such devices for use in machines operating on a demand basis, and does so by means of an extremely simple, inexpensive, and reliable modification of known positive feed devices of the roller/tape type.

BRIEF DESCRIPTION OF THE DRAWINGS

The foregoing objects, advantages, construction, and operation of the present invention will become more readily apparent from the following description and accompanying drawings wherein:

FIG. 1 is a diagrammatic representation of the side view of a circular knitting machine employing the present invention;

FIG. 2 is a side view of the roller/tape portion of a positive feed device of the type employed in the present invention;

FIG. 3A is a side view of the positive feed device of the present invention in its feeding position;

FIG. 3B illustrates the device of 3A in its nonfeed position;

FIG. 4 is a top view of the structure shown in FIGS. 3A and 3B; and

FIG. 5 is a detail view of a mounting structure which may be added to a pre-existing roller/feed device to adapt said device for operation in accordance with the present invention.

DESCRIPTION OF THE PREFERRED EMBODIMENTS

Referring initially to FIG. 1, it will be seen that the circular knitting machine 10 adapted to fabricate, for example, a tube of knit fabric 11 may be provided with a plurality of feeding stations 12 each of which is in turn supplied with a plurality of yarns such as 13, 14, 15 and 16 which are individually demanded by the machine at different times during its operating cycle. The yarns supplied to each feeding station 12 are taken from yarn packages 17 which are mounted on a bobbin rack or yarn package stand 18 supported above the machine on a support tube 19. The yarn ends from the several packages pass over a yarn guide 20 which is also supported on tube 19, and then pass through tension devices for each end (such devices not being shown in FIG. 1, for simplicity, but being in themselves conventional and operating to keep the yarn ends taut), whereafter the yarn ends extend to and through positive feed devices of the general type described earlier comrising a plurality of rotatably mounted rollers 21 and an associated endless tape 22 which is driven by the machine to pass in succession over the running surfaces of the several rollers 21 so as to feed yarn positively from each package 17. For purposes of simplicity, the overall knitting machine arrangement has been only diagrammatically illustrated in FIG. 1, and the actual disposition of yarn packages, as well as the circular array of feeding stations, the number of yarns fed to each station (only one such station being depicted as having yarns fed thereto, again for simplicity) and the specific mounting and driving details of the machine have not been illustrated, all of these features being in themselves well known to those skilled in the art. It will further be appreciated that the specific nature of each feeding station 12 will depend upon the intended operation of the machine, e.g., each such station may comprise a striping box when the machine 10 is designed to produce a tube 11 of striped knit fabric, in which event the several yarns 13–16 can comprise yarns of different colors respectively which are selected in a predetermined and repetitive sequence by the feeding station 12, but the feeding stations may take other forms within the principles of the present invention so long as they are operative to demand different yarns at different times. The number of feeds in the machine will, moreover, depend on the type of machine employed, e.g., the machine may be provided with 12, 16, 32, 36, 44, 48, or other numbers of feeds; and the actual number of yarn packages and their disposition on the stand 18 (or on a side creel located to one side of the machine, to feed the yarn ends horizontally through appropriate guide rings for eventual feeding to the needles of the machine, rather than feeding the yarns vertically from the yarn packages as illustrated in FIG. 1) can accordingly be varied as desired.

The principle upon which the roller/tape feeding devices 21, 22 operates is in itself also well known, and is depicted in FIG. 2 of the drawings. The several rollers 21 are mounted for rotation about a shaft 21*a* on the ends, for example, of a plurality of support arms (not illustrated) which extend radially outward from support tube 19, and the endless tape 22 extends in succession across the running surfaces of the several rollers 21 and is driven in a closed loop, e.g., by an appropriate driving pulley or other mechanism (not illustrated), in synchronism with the operation of the circular knitting machine 10. The tape 22 is narrower than the axial dimension of the running surface of each roller 21 so that, by appropriately positioning yarn relative to the tape 22, the yarn may be either positively fed or nonfed as the tape 22 is translated and the several rollers 21 rotate. More particularly, when yarn is fed into each feed device at the position depicted by arrow A in FIG. 2 so that the yarn is located between tape 22 and the underlying portion of the running surface of roller 21, the yarn is positively fed by the device. However if the yarn position should be displaced to that indicated by arrow B, to extend along the running surface of roller 21 at a position displaced from that of tape 22, the yarn remains stationary along the surface of roller 21 as the roller rotates, and is not positively fed. The yarn may be selectively displaced from position A to position B by displacing appropriate yarn guides which are located adjacent each roller 21. The present invention is directly concerned with this aspect of the yarn feed device, and provides the desired selective displacement in yarn position relative to tape 22 in dependence upon the demand or nondemand for a particular yarn by the needles of machine 10.

In order that this aspect of the invention may be more clearly understood, and by way of illustration only, let us assume for the moment that the machine 10 shown in FIG. 1 is a striping machine, that each feeding station 12 is a striping box, e.g., of the type described in Mishcon et al. U.S. Pat. No. 2,549,701, and that each striping box is supplied with four differently colored yarns 13–16 having respective colors such as red, green, blue and white. During normal operation of such a striping machine, as fully described in said Mishcon et al. patent, only one of the four yarns supplied to each feeding station is selected for use by the machine at any given time, and the machine arrangement is such that the three idle yarns associated with each striping box are merely held by a clamping device in the striping box without any significant tension therein while the fourth, active, yarn is being fed directly to the needles of the machine. When the color is changed during the machine cycle, the previously active yarn is cut by a cutting device associated with the striping box and fed to the aforementioned clamping device in its associated striping box while one of the previously idle yarns is removed from the clamping device and supplied to the needles. The particular one of the four yarns being demanded by the machine at any given time has significant tension therein due to the fact that it is being drawn into the machine, whereas the three idle yarns in the clamping device do not have any significant tension therein, and the particular one of the four yarns which is being drawn into the machine (and the resulting tension therein) will change from one to the next of said yarns in a regular sequence. As will be apparent from FIG. 1, each of the several yarns being fed to a given feeding station passes through an associated one of the roller/tape feeding devices 21, 22, and the arrangement of these feeding devices (to be discussed hereinafter in reference to FIGS. 3–5) is such that the occurrence of tension in a particular yarn, indicating that that yarn is then being demanded by the machine, causes the yarn to be fed into its associated positive feed device along path A (see FIG. 2) whereas the absence of tension in a given yarn (indicating that said given yarn is not then being demanded by the machine) causes the yarn feed position to be automatically shifted to position B.

The modified positive feed device, associated with each yarn, which accomplishes the aforementioned results is depicted in FIGS. 3–5. Each roller 21 is mounted for rotation on a support structure 30 which includes a pair of side flanges 31 that support a bracket 32 for pivotal movement about pivots 33. Bracket 32 includes two portions 32*a*, 32*b* (see FIG. 4) which are interconnected to one another by a cross bar 32*c* for pivotal movement as a unit about pivots 33, the extent of pivotal movement being limited by the opposing ends of a recess 34 which comes into selective engagement with cross bar 32*c* at the opposing ends of a given limited arc of movement.

Portion 32*a* of the pivotal bracket includes a yarn guide taking the form of an eyelet 35, and portion 32*b* carries a similar yarn guide comprising an outlet eyelet 36. The eyelets 35, 36 are disposed in spaced location to one another adjacent the running surface of roller 21 and their respective axes are at right angles to one another so that a length of yarn 17*a* taken from one of the aforementioned yarn packages 17 may extend vertically downward through inlet eyelet 35, and then pass around roller 21, as at 17*b*, to outlet eyelet 36 for feeding to the machine. When the portion of yarn 17*b* is in a position underlying tape 22 (see FIG. 3A, and position A of FIG. 2) the yarn will be positively fed to the machine, whereas when said yarn portion 17*b* passing around the running surface of roller 21 is below or displaced from tape 22 (FIG. 3B, and position B of FIG. 2) the yarn is not positively fed. This displacement of the yarn between the positions shown in FIGS. 3A and 3B is accomplished automatically in dependence upon the tension existing in the yarn representative of the demand or nondemand for that particular yarn.

In order to accomplish the desired shift between yarn positions automatically, a mounting element 37 is affixed, e.g., by screws 38 to the portion 32*b* of freely pivotal bracket 32 at a position behind outlet eyelet 36. Mounting element 37 includes an elongated central member 37*a* (see FIG. 5) which receives mounting screws 38 and which is oriented in a direction at substantially right angles to the extension of bracket 32, i.e., it extends in the direction generally parallel to the axis of rotation of roller 21. The opposing ends of member 37*a* merge smoothly into a pair of elongated transversely oriented arms 37*b*, 37*c* which extend in opposite directions relative to member 37*a* and relative to pivot 33 of the bracket 32. Arm 37*b* includes a plurality of longitudinally spaced holes 39, and a weight 40 is removably attached to said arm 37*b* by insertion in a selected one of said holes 39. Arm 37*c* includes an elongated slot 41 which slidably receives a further weight 42 which may be adjustably positioned at any desired location along slot 41 and then locked in place by a wing nut 43 (see FIG. 4). The free end of arm 37*c* supports yarn guide means comprising a further eyelet 44, and the yarn passing through eyelet 36 is extended, as at 17*c* along the arm 37*c* through eyelet 44 and then extends downwardly, as at 17*b* to the knitting machine.

The several holes 39 in arm 37*b* are in alignment with one another along a line which passes generally through pivot 33, the arm 37*b* being similarly inclined along generally the same line. Weight 40, when mounted in one of the holes 39, accordingly tends to rotate bracket 32 and attached mounting element 37 in a counterclockwise direction (as viewed in FIGS. 3A and 3B), and the rotational influence of weight 40 can be adjusted in increments by varying the moment arm between said weight and pivot point 33, i.e., by selecting the hole 39 in which weight 40 is mounted. Weight 42, on lower arm 37*c*, tends to rotate mounting element 37 in the opposite direction, i.e., in a clockwise direction, and its influence on the rotation may be varied by varying the position of weight 42 along slot 41. When the weight 42 is at the forwardmost end of the slot, i.e., directly below or slightly forward of pivot 33, its influence is negligible, and its clockwise turning moment is increased as the weight 42 is moved rearwardly toward eyelet 44 at increasing distances behind pivot 33. The actual positions of weights 40 and 42 are so selected that, when there is no tension in or downward pull of yarn sections 17*d*, the influence of weight 40 predominates to pivot bracket 32 and its eyelets 35, 36 into a nonfeed position relative to roller 21, as in FIG. 3B.

Weight 42 acts as a fine adjustment on the balance condition to adjust the overall structure for proper operation in dependence upon the actual tension which occurs in yarn section 17*d* when that particular yarn is demanded by the knitting machine. When such demand occurs, the resultant downward pull in yarn section 17*d* (indicated by arrow C in FIG. 3A) exerts a downward force at eyelet 44 on the free end of arm 37*c*, on the opposite side of pivot 33 from weight 40, to cause mounting element 37 and bracket 32 to rotate in a clockwise direction into the positive feed position shown in FIG. 3A. This condition will persist as long as the particular yarn is being demanded by the machine, but as soon as demand for that yarn ceases and the tension in yarn section 17*d* is accordingly terminated, weight 40 will again predominate to rotate mounting element 37, under the influence of gravity, back into the nonfeed position of FIG. 3B.

The arrangement of the present invention thus operates to shift yarn guides or eyelets 35, 36 between feed and nonfeed positions relative to roller 21 in direct response to the demand or nondemand for the particular yarn which passes through a given positive feed device. This action is accomplished, moreover, by a simple mechanical structure which is comparatively inexpensive, free of maintenance, and which can be installed on a knitting machine without requiring any change to the knitting machine itself, or any additions thereto such as control rods, electrical sensor circuits, or the like of the type contemplated in Nance U.S. Pat. No. 3,418,831.

Feed units of the type shown in FIGS. 3 and 4 can be manufactured as original equipment for use in conjunction with demand-type knitting machines. Such feed units may, however, also be provided by a comparatively simple modification of pre-existing, commercially-available positive feed units. Such pre-existing units take the form generally shown in FIGS. 3 and 4, but include a spring biased detent adjacent bracket 32 which normally prevents the bracket from free pivotal motion and which normally locks the bracket 32 in the positive feed position shown in FIG. 3A (units of this type being provided to permit the bracket to be "unsnapped" manually from its feed position into a nonfeed position if there should be a break in the yarn). Such units can be modified to operate in accordance with the present invention by removing the spring detent therefrom and, if necessary, by loosening up pivots 33 to assure that bracket 32 is capable of freely pivotal operation, and by thereafter attaching a mounting element 37 and its associated weights, in the manner generally shown in FIG. 5.

While I have thus described preferred embodiments of the present invention, many variations will be apparent to those skilled in the art. For example the actual shape of mounting element 37 may be varied, the number and nature of the weights carried thereby may be varied, one or both of the weights can comprise an integral part of the structure rather than being adjustable, the incremental adjustment arrangement provided for weight 40 may be replaced by a continuous adjustment arrangement of the type employed in conjunction with weight 42, and vice versa, the orientation of eyelets 35 and 36 may be reversed to interchange the inlet and outlet sides of the feeding device with the mounting element 37 and its associated weights then being disposed on the side of the feeding device opposite to that shown in the drawings, the mounting element may be fabricated of various different materials such as plastic or metal, etc. It must therefore be understood that the foregoing description is intended to be illustrative only and not limitative of the present invention, and all such variations and modifications as are in accord with the principles described are meant to fall within the scope of the appended claims.

Having thus described my invention, I claim:

1. In a knitting machine of the demand type comprising a plurality of yarn packages for supplying yarns upon demand to a plurality of feeding stations via a plurality of positive feed devices, and wherein said positive feed devices comprise a plurality of rotatable rollers associated with a driven tape running along the surfaces of said rollers, the width of said tape being less than the axial dimension of the running surface of each roller whereby a yarn supplied to one of said rollers at a first position between said tape and the running surface of the roller is positively fed to one of said feeding stations whereas a yarn supplied to said one of said rollers at a second position on the running surface of said roller axially displaced from the tape is not positively fed to said one of said feeding stations, and wherein each of said positive feed devices further includes a bracket having inlet and outlet eyelets disposed at spaced locations adjacent the running surface of said roller, said bracket being selectively displaceable between said first and second positions to locate a length of yarn which extends along said running surface from one to the other of said eyelets for positive feed or nonfeed in dependence upon the position of said bracket, the improvement wherein each of said brackets in each of said feed devices is mounted for free pivotal movement through a limited arc adjacent its associated roller, counterbalance means comprising a pair of counterbalance weights, said counterbalance means including mounting means on said bracket comprising a pair of arms located on opposite sides of the pivot point of said bracket, each of said arms including one of said counterbalance weights, said pair of said weights being arranged to normally urge said bracket and its eyelets into said second, nonfeed position adjacent said associated roller under the influence of gravity, and yarn guide means carried by said mounting means for engagement with the yarn in said positive feed device, said yarn guide means being responsive to the presence of a preselected tension in said yarn resulting from a yarn demand by one of said feeding stations for pivoting said bracket against the force of said counterbalance means thereby to displace said bracket and its associated eyelets into said first, positive feed position, whereby the occurrence of tension in a particular yarn due to a demand for said particular yarn by one of said feeding stations automatically positions the demanded yarn in proper position relative to its feed device for positive feed to said feeding station whereas absence of demand for said particular yarn by said one of said feeding stations causes said counterbalance means to automatically position the nondemanded yarn in a different proper position relative to its feed device for nonfeed to said feeding station.

2. The structure of claim 1 wherein said pair of counterbalance weights are attached to said pair of arms respectively, each of said weights being adjustable in position along its respective arm relative to the pivot point of said bracket.

3. The structure of claim 1 wherein said yarn guide means comprises a further eyelet carried by one of said arms.

4. The structure of claim 3 wherein said further eyelet is disposed adjacent an extremity of one of said arms on the side of said pivot point opposite to the side thereof at which said inlet and outlet eyelets are located.

5. The structure of claim 1 wherein said mounting means includes an elongated member extending in a direction generally parallel to the axis of roation of said roller, said pair of arms extending transversely to said member in opposite directions respectively from the opposing ends of said elongated member, said pair of weights being attached to said pair of arms respectively.

6. The structure of claim 5 wherein at least one of said arms includes means for removably attaching one of said weights thereto at any one of a plurality of predetermined locations along said arm.

7. The structure of claim 5 wherein at least one of said arms includes means for attaching one of said weights thereto for slidable positioning along said arm.

8. The structure of claim 1 wherein said knitting machine is a striping machine, each of said feeding stations comprising a striping box having a plurality of differently colored yarns supplied thereto from a plurality of said yarn packages respectively via a corresponding plurality of said positive feed devices.

* * * * *